US011228841B2

(12) United States Patent
Yoon

(10) Patent No.: US 11,228,841 B2
(45) Date of Patent: Jan. 18, 2022

(54) SPEAKER

(71) Applicant: SAMSUNG ELECTRONICS CO., LTD., Suwon-si (KR)

(72) Inventor: Eui Han Yoon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/757,612

(22) PCT Filed: Aug. 30, 2018

(86) PCT No.: PCT/KR2018/010076
§ 371 (c)(1),
(2) Date: Apr. 20, 2020

(87) PCT Pub. No.: WO2019/078481
PCT Pub. Date: Apr. 25, 2019

(65) Prior Publication Data

US 2020/0329314 A1 Oct. 15, 2020

(30) Foreign Application Priority Data

Oct. 20, 2017 (KR) ..... 10-2017-0136272

(51) Int. Cl.
*H04R 9/02* (2006.01)

(52) U.S. Cl.
CPC ..... *H04R 9/025* (2013.01); *H04R 2307/201* (2013.01)

(58) Field of Classification Search
CPC ... H04R 7/12; H04R 7/16; H04R 7/26; H04R 9/043; H04R 9/045; H04R 9/025
See application file for complete search history.

(56) References Cited

U.S. PATENT DOCUMENTS 5,619,019 A * 4/1997 Yoshimura ..... H04R 7/26 181/166
9,277,303 B2 * 3/2016 Busenitz ..... H04R 31/003
9,743,194 B1 8/2017 MacLean
2007/0189576 A1 * 8/2007 Chan ..... H04R 9/06 381/404
2009/0116680 A1 * 5/2009 Funahashi ..... H04R 9/043 381/400

FOREIGN PATENT DOCUMENTS

KR 10-2008-0014879 A 2/2008
KR 10-2008-0064477 A 7/2008
(Continued)

OTHER PUBLICATIONS

International Search Report dated Jan. 2, 2019 issued by the International Searching Authority in counterpart International Application No. PCT/KR2018/010076 (PCT/ISA/210).
(Continued)

*Primary Examiner* — Sunita Joshi
(74) *Attorney, Agent, or Firm* — Sughrue Mion, PLLC

(57) ABSTRACT

Disclosed herein is a speaker. The speaker includes a magnetic circuit device provided to generate a magnetic force, a voice coil configured to vibrate by the magnetic circuit device, and a damper configured to guide a movement of the voice coil, wherein the damper comprises a first portion, and a second portion having a different weave than the first portion.

13 Claims, 10 Drawing Sheets

(56) References Cited

FOREIGN PATENT DOCUMENTS

| | | | |
|---|---|---|---|
| KR | 10-0930537 | B1 | 12/2009 |
| KR | 10-1116307 | B1 | 3/2012 |
| KR | 10-1322853 | B1 | 10/2013 |

OTHER PUBLICATIONS

Communication dated Oct. 1, 2020 issued by the European Patent Office in European Application No. 18867907.0.
Communication dated May 10, 2021 issued by the European Intellectual Property Office in counterpart European Application No. 18 867 907.0.
Communication dated Jul. 22, 2021 issued by the Korean Patent Office in Counterpart Korean Application No. 10-2017-0136272.

* cited by examiner

SPEAKER

TECHNICAL FIELD

The present disclosure relates to a speaker, and more particularly, to a speaker having an improved structure.

BACKGROUND ART

A speaker is sound equipment which converts electrical signals output from an audio amplifier into vibrations of a vibrator to generate waves of condensation and rarefaction in the air to radiate sound waves. There are many types of speakers including a magnetic type, a dynamic type, a condenser type, a piezo-electric type, and a ceramic type.

Generally, a speaker includes: a magnetic circuit device composed of a magnet for generating a magnetic flux, a yoke part for providing a path of the magnetic flux, and a bobbin around which a voice coil is wound; and a vibration system including a diaphragm vibrating according to movements of the bobbin, a damper for adjusting a vibration direction of the diaphragm, and an edge which fixes the outside edge of the diaphragm to a frame.

Therefore, when current is applied to the voice coil, the magnetized voice coil interacts with a magnetic flux generated by the magnet to move back and forth, so that the diaphragm vibrates to generate sound pressure.

Specifically, the vibration system of the speaker controls the vertical amplitude using the edge and the damper.

However, generally, when the vibration system operates with a vertical amplitude (large amplitude), the vibration system has a nonlinear characteristic to generate split vibrations, and due to the split vibrations and nonlinear characteristic, an undesirable distortion factor in the frequency characteristic increases, resulting in a frequency characteristic distortion.

DISCLOSURE

Technical Problem

Therefore, it is an aspect of the present disclosure to provide a speaker capable of reducing the generation of a distortion factor and a distortion, while securing linearity of a vibration plate.

It is another aspect of the present disclosure to provide a speaker capable of improving a low limit frequency.

Technical Solution

In accordance with an aspect of the present disclosure, a speaker includes a magnetic circuit device configured to generate a magnetic force, a voice coil configured to vibrate by the magnetic circuit device, and a damper configured to guide a movement of the voice coil, wherein the damper comprises a first portion and a second portion having a different weave from the first portion.

The first portion may be connected to the second portion by sewing.

The second portion may be connected to an outer circumference of the first portion.

The second portion may be connected to one side of the first portion along a circumferential direction of the damper.

The first portion may have a weave among a plain weave, a twill weave, and a satin weave, the second portion may have a different weave from the first portion among the plain weave, the twill weave, and the satin weave.

The first portion and the second portion may be disposed along a radial direction of the damper.

The first portion and the second portion may be disposed along a circumferential direction of the damper.

The damper may further include a reinforcing member disposed at an area where the first portion is connected to the second portion.

The reinforcing member may be configured to have denser embroidery than the first portion and the second portion.

The damper may include a load reinforcing portion provided at a portion where the first portion and the second portion are bonded.

The load reinforcing portion may have a depressed part or a protruding part.

The first portion may be bonded to the second portion by an adhesive.

The first portion may have a first corrugation, and the second portion may have a second corrugation having a size that is different from a size of the first corrugation.

In accordance with another aspect of an example embodiment, a speaker includes a magnetic circuit device configured to generate a magnetic force, a voice coil configured to vibrate by the magnetic circuit device, and a damper configured to guide a movement of the voice coil, wherein the damper comprises a first portion, a second portion having a different weave from the first portion, and connected to the first portion by sewing, and a load reinforcing portion provided at an area where the first portion is connected the second portion.

The first portion and the second portion may be disposed along a radial direction of the damper.

The load reinforcing portion may have a depressed part or a protruding part.

The damper may further include a reinforcing member disposed between the first portion and the second portion.

The reinforcing member may be configured to have denser embroidery than the first portion and the second portion.

The first portion may have a weave among a plain weave, a twill weave, and a satin weave, and the second portion may have a different weave from the first portion among the plain weave, the twill weave, and the satin weave.

In accordance with still another aspect of an example embodiment, a speaker includes a magnetic circuit device configured to generate a magnetic force, a voice coil configured to vibrate by the magnetic circuit device, and a damper configured to guide a movement of the voice coil, and having a first portion and a second portion having a different weave from the first portion, wherein the first portion comprises a first load reinforcing portion connected to the second portion, the second portion comprises a second load reinforcing portion connected to the first portion, and the damper comprises a reinforcing member disposed between the first load reinforcing portion and the second load reinforcing portion.

Advantageous Effects

According to a technical concept of the present disclosure, since a portion of the damper has a different weave from the other portion, the speaker may reduce the generation of a distortion factor and a distortion, while securing the linearity of the vibration plate.

According to another technical concept of the present disclosure, since a portion of the damper has a different weave from the other portion, the speaker may improve a low limit frequency.

BEST MODE

Modes of the Invention

Figure 1:
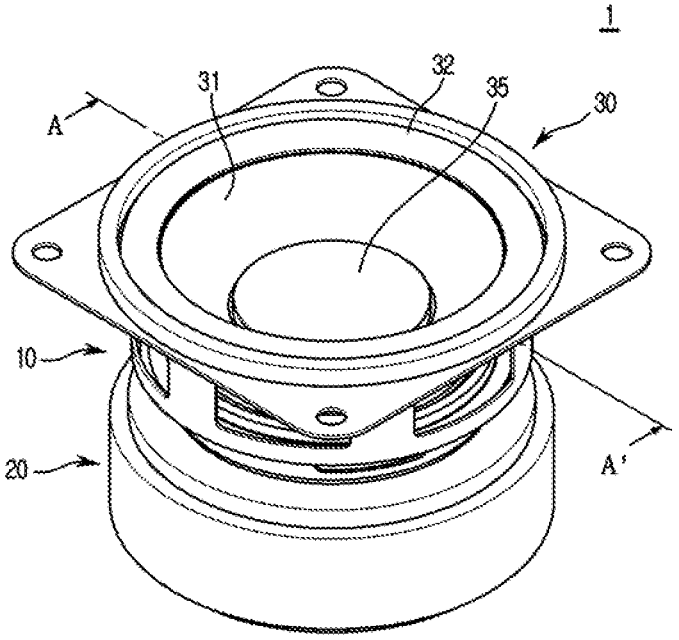
FIG. 1 shows a speaker according to an embodiment of the present disclosure.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

The terms used in the present specification are used to describe the embodiments of the present disclosure. Accordingly, it should be apparent to those skilled in the art that the following description of exemplary embodiments of the present disclosure is provided for illustration purpose only and not for the purpose of limiting the disclosure as defined by the appended claims and their equivalents. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

It will be understood that, although the terms "first", "second", etc., may be used herein to describe various elements, these elements should not be limited by these terms. The above terms are used only to distinguish one component from another. For example, a first component discussed below could be termed a second component, and similarly, the second component may be termed the first component without departing from the teachings of this disclosure. As used herein, the term "and/or" includes any and all combinations of one or more of the associated listed items.

Meanwhile, in the following description, the terms "front", "rear", "upper", and "lower" are defined based on the drawings, and the shapes and positions of the components are not limited by the terms.

Hereinafter, the embodiments of the present disclosure will be described in detail with reference to the accompanying drawings.

Figure 2:
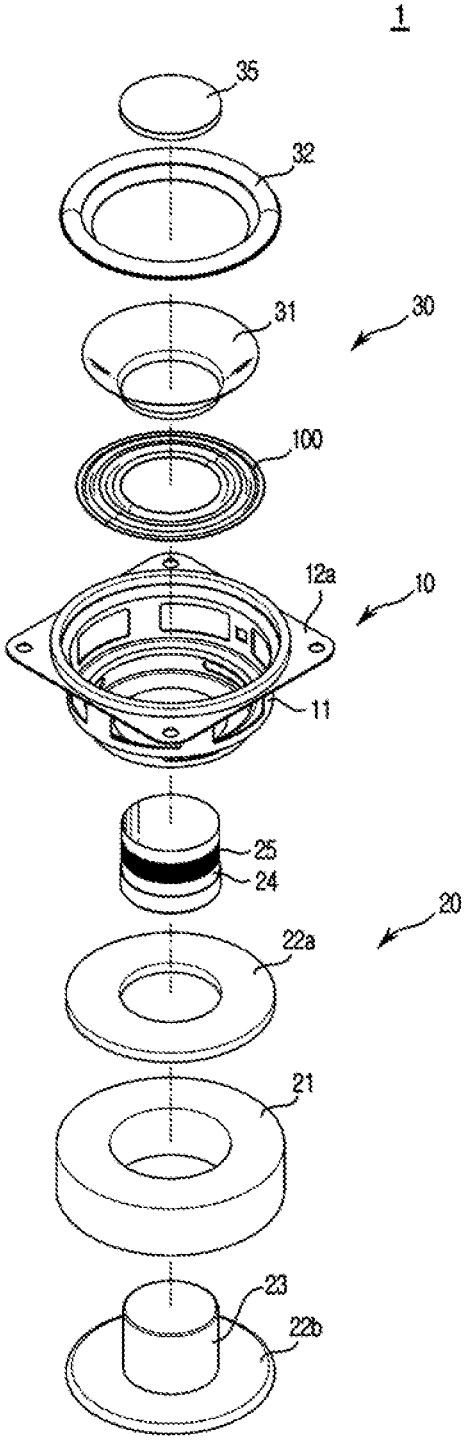
FIG. 2 is an exploded perspective view of the speaker shown in FIG. 1.
Figure 3:
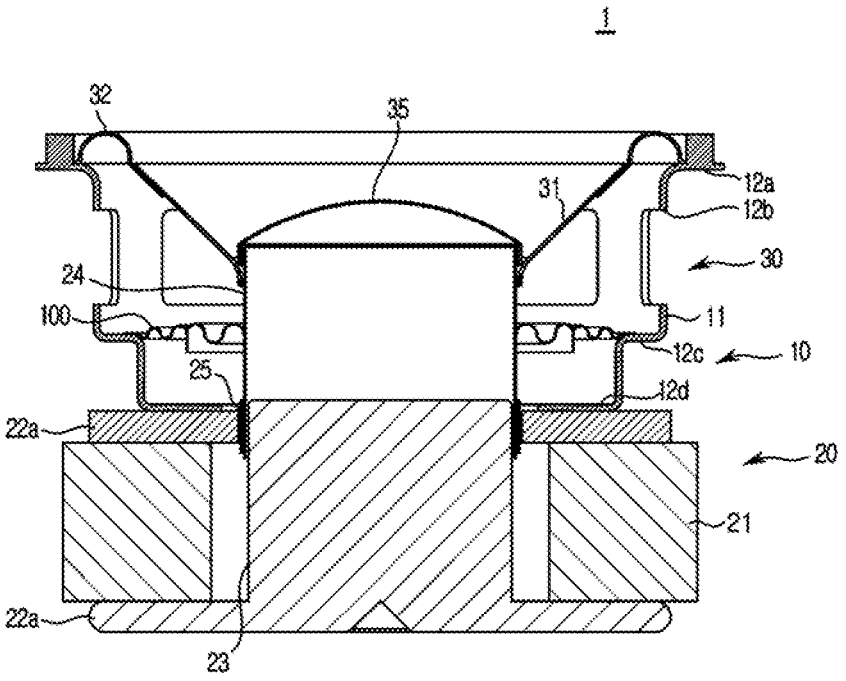
FIG. 3 is a cross-sectional view of the speaker shown in FIG. 1, taken along a line A-A' of FIG. 1.

FIG. 1 shows a speaker according to an embodiment of the present disclosure. FIG. 2 is an exploded perspective view of the speaker shown in FIG. 1. FIG. 3 is a cross-sectional view of the speaker shown in FIG. 1, taken along a line A-A' of FIG. 1.

As shown in FIGS. 1 to 3, a speaker 1 may include a frame 10 having a hollow portion, a magnetic circuit device 20 disposed inside the frame 10, and a vibrator 30 configured to vibrate by the magnetic circuit device 20.

The frame 10 may form an outer appearance of the speaker 1, and may include a body 11 formed in the shape of a hollow cylinder at the center.

The body 11 of the frame 10 may include a first flange 12*a* formed at the upper end, a second flange 12*b* spaced a predetermined distance downward from the first flange 12*a*, a third flange 12*c* spaced a predetermined distance downward from the second flange 12*b*, and a fourth flange 12*d* spaced a predetermined distance downward from the third flange 12*c* and formed inward at a lower end of the body 11.

The second flange 12*b* may extend inward from the first flange 12*a*, the third flange 12*c* may extend inward from the second flange 12*b*, and the fourth flange 12*d* may extend inward from the third flange 12*c*.

Accordingly, the frame 10 may be in the shape of a funnel or cone whose diameter increases from bottom to top. The frame 10 may be formed to correspond to the shape of a vibration plate 31 or to be larger than the vibration plate 31 so as to surround the vibration plate 31.

Hereinafter, when the surfaces and directions of components including the frame 10 are referred to, the surface and the direction of the frame 10 toward the upper side in the vertical direction will be referred to as an "upper surface" and an "upper direction", and the surface and the direction of the frame 10 toward the lower side in the vertical direction will be referred to as a "lower surface" and a "lower direction".

The magnetic circuit device 20 may be disposed below the frame 10, and the vibrator 30 may be disposed on an upper, inner portion of the frame 10.

In the current embodiment, an example in which the frame 10 is formed in the shape of a cylinder is shown, however, the frame 10 may be in the shape of a hollow funnel or cone whose upper end portion has a greater diameter than the lower end portion.

The magnetic circuit device 20 may be a component for transmitting electrical signals in order to generate sound from the speaker. The magnetic circuit device 20 may include a magnet 21, an upper plate 22*a* and a lower plate 22*b* disposed above and below the magnet 21, respectively, and a pole piece 23 disposed in a center of the magnet 21.

Although the lower plate 22*b* and the pole piece 23 are integrated into one body in the embodiment of the present disclosure, the concept of the present disclosure is not limited thereto. For example, the lower plate 22*b* and the pole piece 23 may be separately formed and then combined together.

The pole piece 23 may form a path of a magnetic flux generated from the magnet 21.

The magnet 21 may have a plurality of poles including a N pole and a S pole, and may be magnetized in a direction from front to back. Hereinafter, a front direction indicates an upward direction in FIG. 1 as a direction in which sound waves are headed from the speaker 1, and a rear direction indicates a downward direction in FIG. 1.

The magnet 21 may be made of neodymium, ferrite, or another permanent magnet material. The magnet 21 may be in the shape of a hollow ring.

The upper plate 22*a* and the lower plate 22*b* disposed respectively above and below the magnet 21 to support the magnet 21 may be formed with a size and shape corresponding to each other.

The upper plate 22*a* may be fixed in contact with the fourth flange 12*d* formed at the lower end of the frame 10 which will be described later.

The vibrator 30 may include a voice coil 25 configured to vibrate by interworking with the magnetic circuit device 20, a bobbin 24 around which the voice coil 25 is wound, the vibration plate 31 configured to reproduce sound by vibrating by the voice coil 25, an edge 32 connecting the vibration plate 31 to the frame 10, a damper 100 configured to guide a movement direction of the voice coil 25 to a vertical direction and to restrict a movement in horizontal direction of the voice coil 25, and a dust cap 35 coupled to the bobbin 24.

The dust cap 35 may be mounted on an upper end portion of the bobbin 24 to prevent foreign materials from entering the inside of the vibrator 30, such as the bobbin 24 and the voice coil 25.

The dust cap 35 may be adhered on and fixed at an inner center of the vibration plate 31.

The voice coil 25 may be magnetized, when current is applied thereto, to interact with a magnetic flux generated in the magnet 21, thereby moving.

The vibration plate 31 may generate different vibrations according to sound to transmit sound to the outside.

In the current embodiment of the present disclosure, the vibration plate 31 may be in the shape of a funnel or cone having a concave portion at the center, however, the concept of the present disclosure is not limited thereto. For example, the vibration plate 31, which is a key component to determine the sound quality, tone, and frequency characteristics of the speaker 1, may be formed with different acoustic characteristics depending on its material, mass, and structure.

Meanwhile, when an electrical signal is inputted to the speaker 1, the electrical signal may flow to the voice coil 25 of the bobbin 24, and accordingly, the voice coil 25 located in a magnetic field formed by the magnet 21 may perform a reciprocating motion vertically by the Fleming's left-hand rule.

The reciprocating motion of the voice coil 25 may vertically vibrate the vibration plate 31 which is in contact with the bobbin 24 to compress or expand air in contact with the vibration plate 31, thereby generating sound waves and outputting sound.

The edge 32 may connect the vibration plate 31 to the frame 10. The edge 32 may fix the vibration plate 31 at the frame 10. The edge 32 may be formed in the shape of a ring having an opening at the center. The center opening of the edge 32 may have a size corresponding to an upper edge of the vibration plate 31. The edge 32 may be molded with a sheet-shaped material.

One end of the edge 32 may be in contact with the first flange 12*a* of the body 11 of the frame 10. The other end of the edge 32 that is opposite to the one end may be fixedly adhered on the outer surface of the vibration plate 31. The first flange 12*a* of the frame 10 may be formed in the shape of a circle corresponding to one end of the edge 32. The edge 32 may be fixed at the vibration plate 31 and the frame 10 through an adhesive.

Figure 4:
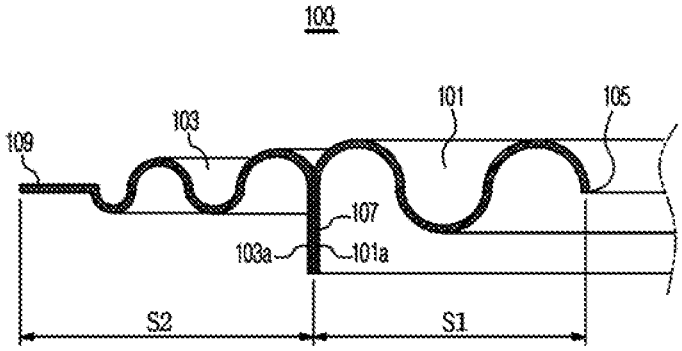
FIG. 4 shows a portion of a cross-section of a damper shown in FIG. 3.
Figure 5:
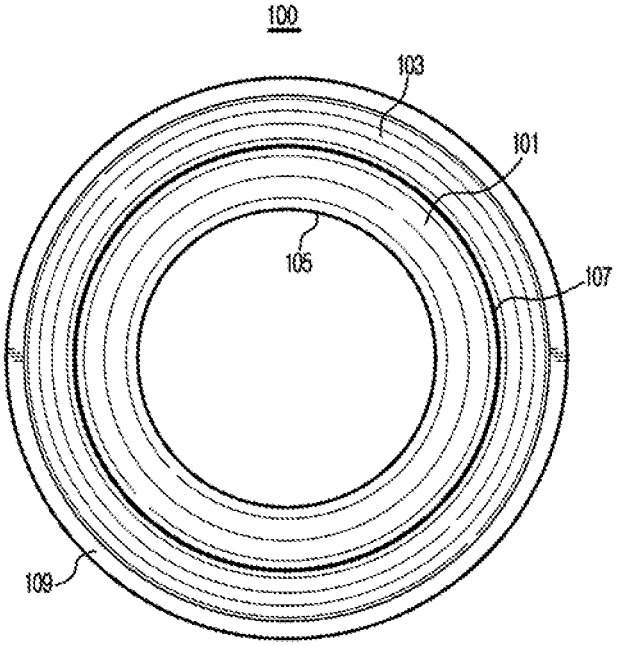
FIG. 5 is a top view of a damper shown in FIG. 2.
Figure 6:
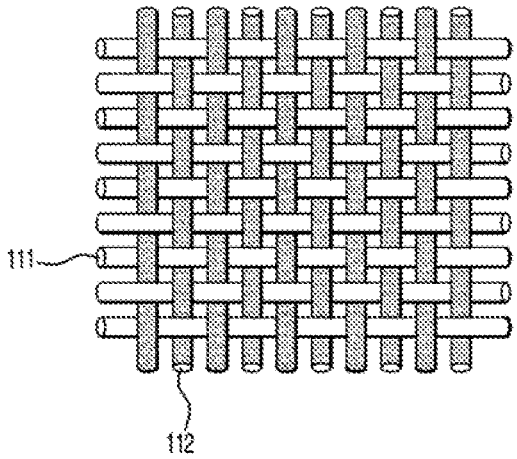
FIGS. 6 to 8 show various examples of weaves that are used in a damper shown in FIG. 5.
Figure 7:
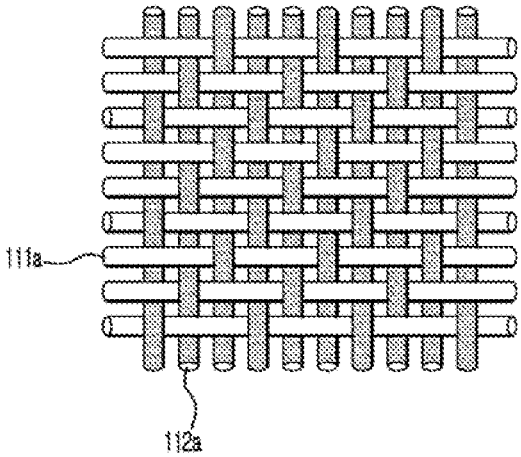
Figure 8:
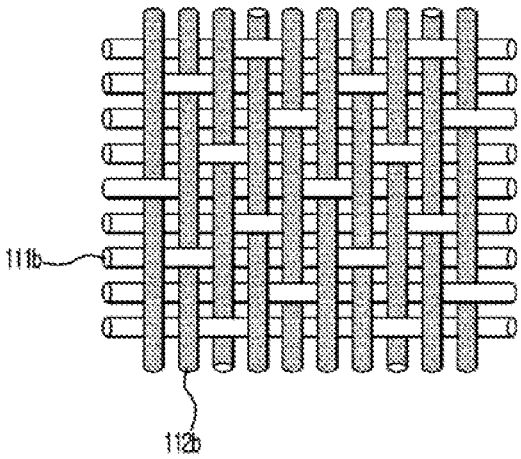

FIG. 4 shows a portion of a cross-section of a damper shown in FIG. 3. FIG. 5 is a top view of a damper shown in FIG. 2. FIGS. 6 to 8 show various examples of weaves that are used in a damper shown in FIG. 5.

Referring to FIGS. 4 and 5, the damper 100 may include a first portion 101, and a second portion 103 having a different weave from the first portion 101.

The first portion 101 may be connected to the second portion 103 by sewing with the second portion 103. The first portion 101 may be connected to an inner circumference of the second portion 103. The second portion 103 may be connected to an outer circumference of the first portion 101. The first portion 101 and the second portion 103 may be sequentially disposed along a radial direction of the damper 100. Alternatively, the first portion 101 may be bonded to the second portion 103 by an adhesive.

The first portion 101 may correspond to a first section S1 along the radial direction, and the second portion 103 may correspond to a second section S2. The first portion 101 and the second portion 103 may have the same area. However, the present disclosure is not limited to this, and the first portion 101 and the second portion 103 may have different areas in order to secure mechanical rigidity required for design.

The first portion 101 may have a first corrugation, and the second portion 103 may have a second corrugation. The first corrugation and the second corrugation may have different sizes. As shown in FIG. 4, in the damper 100, a pitch and depth of the first corrugation of the first portion 101 may be greater than those of the second corrugation of the second portion 103. In contrast, although not shown, the pitch and depth of the first corrugation of the first portion 101 may be smaller than those of the second corrugation of the second portion 103. However, the pitch and depth of the first corrugation of the first portion 101 may be equal to those of the second corrugation of the second portion 103.

An opening 105 which the voice coil 25 is inserted into and fixed at may be formed in an inward direction from the first portion 101. The opening 105 may be formed to correspond to the size of the voice coil 25. The damper 100 may guide a vertical movement of the voice coil 25, while restricting a horizontal movement of the voice coil 25, in the state in which the voice coil 25 is inserted in and fixed at the hollow portion 105.

In the other end of the second portion 103 that is opposite to the one end of the second portion 103 bonded to the first portion 101, a fixing portion 109 fixed at the third flange 12*c* of the body 11 may be formed. The damper 100 may move up and down when the first corrugation of the first portion 101 and the second corrugation of the second portion 103 pitch and roll, in the state in which the fixing portion 109 is fixed at the body 11.

The first portion 101 may have approximately the same area as the second portion 103. However, the first portion 101 may have a larger area than the second portion 103 or a smaller area than the second portion, as needed.

Hereinafter, weaves of the first portion 101 and the second portion 103 will be described with reference to FIGS. 6 to 8.

Referring to FIG. 6, a plain weave may be formed by crossing wefts 111 with warps 112 one by one alternately. Therefore, the plain weave may have a large number of intersections, and the texture may be hard.

Referring to FIG. 7, a twill weave may be formed by crossing wefts 111*a* with warps 112*a* while skipping over two or more. Therefore, the twill weave may have a smaller number of intersections than the plain weave, and the texture may also be less hard than the plain weave.

Referring to FIG. 8, a satin weave may be formed by dispersing wefts 111*b* or warps 112*b* while making a minimum number of intersections so that any ones of the wefts 111*b* and the warps 112*b* appear on the surface. Therefore, the satin weave may have a smallest number of intersections than the twill weave, and accordingly, the texture may be weakest.

The first portion 101 may be formed in one of the plain weave, the twill weave, and the satin weave. For example, the first portion 101 may be formed in the plain weave to increase mechanical rigidity according to design needs. Also, the first portion 101 may be formed in the satin weave to reduce mechanical rigidity according to design needs. Also, the first portion 101 may be formed in one of the plain weave, the twill weave and the satin weave in consideration of the weave of the second portion 103, in order to secure required mechanical rigidity in combination with the second portion 103.

The second portion 103 may be formed in one of the plain weave, the twill weave, and the satin weave. The second portion 103 may be formed in one of the plain weave, the twill weave, and the satin weave, wherein the weave of the second portion 103 may be different from that of the first portion 101. More specifically, when the first portion 101 is formed in the plain weave in order to ensure mechanical rigidity required for the design of the damper 100, the second portion 103 may be formed in the twill weave or the satin weave. Also, when the first portion 101 is formed in the twill weave, the second portion 103 may be formed in the plain weave or the satin weave. Also, when the first portion 101 is formed in the satin weave, the second portion 103 may be formed in the plain weave or the twill weave.

For example, the second portion 103 may be formed in the plain weave in order to increase mechanical rigidity according to design needs. Also, the second portion 103 may be formed in the satin weave in order to reduce mechanical rigidity according to design needs. Also, the second portion 103 may be formed in one of the plain weave, the twill weave and the satin weave in consideration of the weave of the first portion 101, in order to secure required mechanical rigidity in combination with the first portion 101.

The damper 100 may further include a reinforcing member 107 disposed at an area where the first portion 101 is connected to the second portion 103. The reinforcing member 107 may solve a problem that it is difficult to firmly connect the first portion 101 to the second portion 103 even if sewing is performed because the weave of the first portion 101 is different from that of the second portion 103. That is, the reinforcing member 107 may enable the first portion 101 to be more firmly connected to the second portion 103 when the first portion 101 is connected to the second portion 103 by sewing. The reinforcing member 107 may have denser embroidery than the first portion 101 and/or the second portion 103.

The damper 100 may include load reinforcing portions 101*a* and 103*a* disposed at the area where the first portion 101 is connected to the second portion 103. The load reinforcing portions 101*a* and 103*a* may include a first load reinforcing portion 101*a* extending from the first portion 101 and a second load reinforcing portion 103*a* extending from the second portion 103.

The first load reinforcing portion 101*a* may extend a predetermined length downward from an end of the first portion 101 that is connected to the second portion 103.

The second load reinforcing portion 103*a* may extend a predetermined length downward from an end of the second portion 103 that is connected to the first portion 101.

The first load reinforcing portion 101*a* and the second load reinforcing portion 103*a* may have a predetermined length in order to secure the load of the damper 100 required for design.

According to this configuration, the damper 100 according to the current embodiment of the present disclosure may secure mechanical rigidity according to design needs because a portion of the damper 100 has a different weave from the other portion, and accordingly, the damper 100 may improve sound quality. In addition, the damper 100 may easily secure a numerical value of a lower limit frequency required for design according to the above-described configuration.

Figure 9:
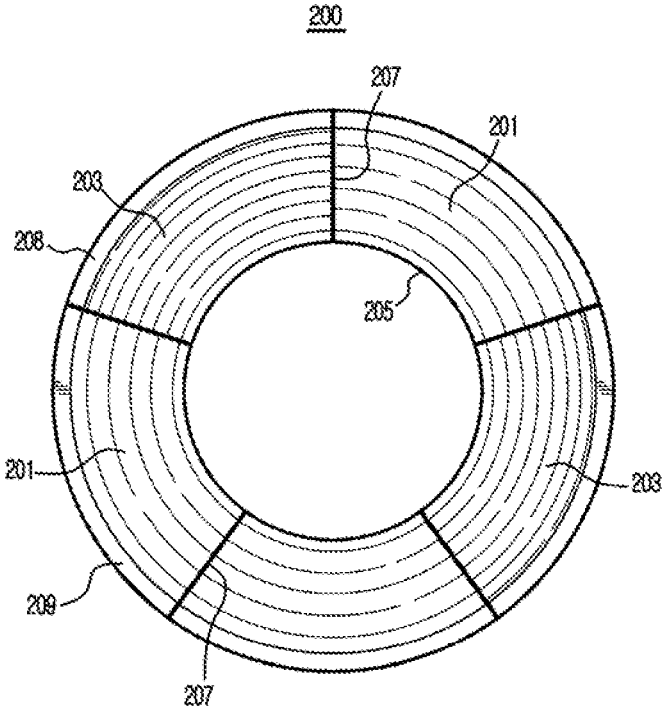
FIG. 9 is a top view of a damper according to another embodiment.

FIG. 9 is a top view of a damper according to another embodiment.

Referring to FIG. 9, a damper 200 according to another embodiment of the present disclosure will be described. In the following description about the embodiment shown in FIG. 9, the same components as those shown in FIGS. 4 to 8 are assigned the same reference numerals, and descriptions thereof will be omitted.

Referring to FIG. 9, the damper 200 may include a first portion 201, and a second portion 203 connected to one side of the first portion 201 along a circumferential direction of the damper 200. That is, the first portion 201 and the second portion 203 may be disposed along the circumferential direction of the damper 200. The damper 200 may be configured such that portions having different weaves are disposed along the circumferential direction in order to ensure mechanical rigidity required for design.

The first portion 201 and the second portion 203 may have different weaves. The first portion 201 may be formed in one of the plain weave, the twill weave, and the satin weave. The second portion 203 may be formed in one of the plain weave, the twill weave, and the satin weave, wherein the weave of the second portion 202 may be different from that of the first portion 201.

In FIG. 9, three first portions 201 and two second portions 203 are shown. However, the numbers of the first portions 201 and the second portions 203 are not limited to these. That is, the number of the second portions 203 may be more than the number of the first portions 201, or the number of the first portions 201 may be the same as the number of the second portions 203, in order to secure mechanical rigidity required for design.

The first portion 201 and the second portion 203 may have the same area. However, the present disclosure is not limited thereto, and the first portion 201 and the second portion 203 may have different areas in order to ensure mechanical rigidity required for design.

An opening 205 which the voice coil 25 is inserted in and fixed at may be formed in the inward direction from the first portion 201.

The damper 200 may further include a reinforcing member 207 disposed at an area where the first portion 201 is connected to the second portion 203. The reinforcing member 207 may enable the first portion 201 to be more firmly connected to the second portion 203 when the first portion 201 is connected to the second portion 203 by sewing.

A first fixing portion 209 may be formed at an outer end of the first portion 201 to be fixed to the third flange 12*c* of the body 11. A second fixing portion 208 may be formed at the outer end of the second portion 203 to be fixed to the third flange 12*c* of the body 11.

Figure 10:
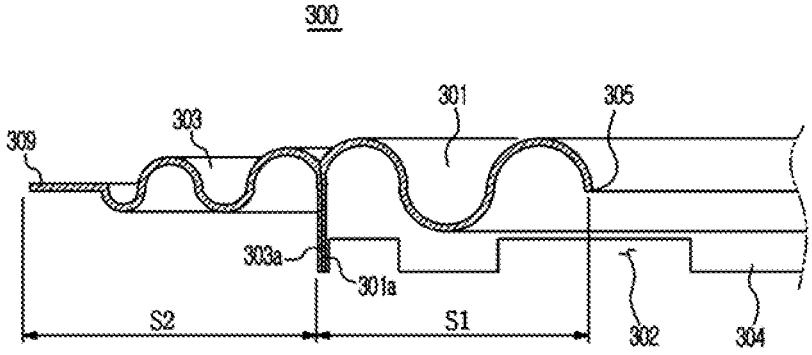
FIG. 10 is a cross-sectional view of a damper according to still another embodiment.

FIG. 10 is a cross-sectional view of a damper according to still another embodiment.

Referring to FIG. 10, a damper 300 according to still another embodiment of the present disclosure will be described. In the following description about the embodiment shown in FIG. 10, the same components as those shown in FIGS. 4 to 9 are assigned the same reference numerals, and descriptions thereof will be omitted.

The damper 300 may include a first portion 301, and a second portion 303 having a different weave from the first portion 301. The first portion 301 and the second portion 303 may be arranged sequentially along a radial direction. The first portion 301 may correspond to a first section S1 along the radial direction, and the second portion 303 may correspond to a second section S2 along the radial direction.

An opening 305 which the voice coil 25 is inserted in and fixed at may be formed in the inward direction from the first portion 301.

A fixing portion 309 fixed at the third flange 12*c* of the body 11 may be formed at the other end of the second portion 303 that is opposite to one end of the second portion 303 connected to the first portion 301.

The damper 300 may include load reinforcing portions 301*a* and 303*a* disposed at an area where the first portion 301 is connected to the second portion 303. The load reinforcing portions 301*a* and 303*a* may include a first load reinforcing portion 301*a* extending from the first portion 301, and a second load reinforcing portion 303*a* extending from the second portion 303.

The load reinforcing portions 301*a* and 303*a* may be cut at one part in order to ensure mechanical rigidity required for design. That is, the load reinforcing portions 301*a* and 303*a* may be formed in a concavo-convex shape having a depressed portion 302 or a protruding portion 304. In this case, the depressed portion 302 or the protruding portion 304 may have a size with which it can secure a load required for design.

In FIG. 10, the load reinforcing portions 301*a* and 303*a* have a saw-tooth shape, but the shape of the load reinforcing portions 301*a* and 303*a* is not limited thereto. For example, the load reinforcing portions 301*a* and 303*a* may be formed in a wave pattern. Also, although FIG. 10 shows a plurality of depressed portions 302 and a plurality of protruding portions 304, it may be also possible that a single depressed portion 302 and a single protruding portion 304 are provided.

The damper 300 may not include the reinforcing member 107 shown in FIG. 4.

Although a few embodiments of the present disclosure have been shown and described, it would be appreciated by those skilled in the art that changes may be made in these embodiments without departing from the principles and spirit of the disclosure, the scope of which is defined in the claims and their equivalents.

The invention claimed is:

1. A speaker comprising:

a magnetic circuit device configured to provide a magnetic force;

a voice coil configured to vibrate by the magnetic circuit device; and a damper configured to guide a movement of the voice coil, wherein the damper includes a first portion, a second portion having a different weave from the first portion, and a reinforcing member having an embroidery that is denser than the first portion and the second portion, wherein the first portion has a weave among a plain weave, a twill weave, and a satin weave, and wherein the second portion has a different weave from the first portion among the plain weave, the twill weave, and the satin weave.

2. The speaker according to claim 1, wherein the first portion is connected to the second portion by sewing.

3. The speaker according to claim 1, wherein the second portion is connected to an outer circumference of the first portion.

4. The speaker according to claim 1, wherein the second portion is connected to one side of the first portion along a circumferential direction of the damper.

5. The speaker according to claim 1, wherein the first portion and the second portion are disposed along a radial direction of the damper.

6. The speaker according to claim 1, wherein the first portion and the second portion are disposed along a circumferential direction of the damper.

7. The speaker according to claim 1, wherein the damper further includes a reinforcing member disposed at an area where the first portion is connected to the second portion.

8. The speaker according to claim 1, wherein the damper includes a load reinforcing portion provided at a portion where the first portion and the second portion are bonded.

9. The speaker according to claim 8, wherein the load reinforcing portion has a depressed part or a protruding part.

10. The speaker according to claim 1, wherein the first portion is bonded to the second portion by an adhesive.

11. The speaker according to claim 1, wherein the first portion has a first corrugation, and the second portion has a second corrugation having a size that is different from a size of the first corrugation.

12. A speaker comprising:

a magnetic circuit device configured to provide a magnetic force;

a voice coil configured to vibrate by the magnetic circuit device; and a damper configured to guide a movement of the voice coil, wherein the damper includes:

a first portion;

a second portion having a different weave from the first portion, and connected to the first portion by sewing; and a load reinforcing portion provided at an area where the first portion is connected the second portion, the load reinforcing portion having a depressed part or a protruding part, wherein the first portion has a weave among a plain weave, a twill weave, and a satin weave, the second portion has a different weave from the first portion among the plain weave, the twill weave, and the satin weave.

13. A speaker comprising:

a magnetic circuit device configured to provide a magnetic force;

a voice coil configured to vibrate by the magnetic circuit device; and a damper configured to guide a movement of the voice coil, and having a first portion and a second portion having a different weave from the first portion, wherein the first portion includes a first load reinforcing portion connected to the second portion, the second portion includes a second load reinforcing portion connected to the first portion, and the damper includes a reinforcing member disposed between the first load reinforcing portion and the second load reinforcing portion.

* * * * *